US010888133B2

(12) United States Patent
Merszei

(10) Patent No.: US 10,888,133 B2
(45) Date of Patent: Jan. 12, 2021

(54) SELF-ENGAGING EYELASHES EXTENSION SET

(71) Applicant: NovaLash, Inc., Houston, TX (US)

(72) Inventor: Sophy Merszei, Houston, TX (US)

(73) Assignee: NovaLash, Inc., Houston, TX (US)

( * ) Notice: Subject to any disclaimer, the term of this patent is extended or adjusted under 35 U.S.C. 154(b) by 0 days.

(21) Appl. No.: 15/963,572

(22) Filed: Apr. 26, 2018

(65) Prior Publication Data

US 2018/0242671 A1 Aug. 30, 2018

Related U.S. Application Data

(63) Continuation of application No. 14/885,492, filed on Oct. 16, 2015, now Pat. No. 10,716,349, which is a continuation of application No. 13/952,352, filed on Jul. 26, 2013, now Pat. No. 9,185,943, which is a continuation of application No. 11/695,033, filed on Apr. 1, 2007, now abandoned.

(60) Provisional application No. 60/744,131, filed on Apr. 2, 2006.

(51) Int. Cl.
*A41G 5/02* (2006.01)

(52) U.S. Cl.
CPC ..... *A41G 5/02* (2013.01)

(58) Field of Classification Search
CPC ..... A41G 5/02
USPC ..... 132/53, 56, 201
See application file for complete search history.

(56) References Cited

U.S. PATENT DOCUMENTS 5,722,434 A * 3/1998 Walker ..... A41G 5/0073 132/201
7,201,171 B2 * 4/2007 Sthair ..... A41G 5/004 132/201
2003/0005941 A1 * 1/2003 Iosilevich ..... A41G 5/02 132/53
2007/0272264 A1 * 11/2007 Byrne ..... A41G 5/02 132/201

* cited by examiner

*Primary Examiner* — Cris L. Rodriguez
*Assistant Examiner* — Brianne E Kalach
(74) *Attorney, Agent, or Firm* — Conley Rose, P.C.

(57) ABSTRACT

A method of applying an artificial eyelash extension system includes positioning a first eyelash extension unit above a wearer's natural eyelashes, positioning a second eyelash extension unit below a wearer's natural eyelashes, contacting a support strip of the first eyelash extension unit with a support strip of the second eyelash extension unit, and engaging the support strips such that the support strips are sandwiched about and retained on the natural eyelashes. The method may include attaching the support strips such that the support strips are sandwiched about and retained on the natural eyelashes. The method may include retaining the support strips such that the support strips are sandwiched about and attached to the natural eyelashes.

20 Claims, 3 Drawing Sheets

SELF-ENGAGING EYELASHES EXTENSION SET

CROSS-REFERENCE TO RELATED APPLICATIONS

The present application is a continuation of U.S. patent application Ser. No. 14/885,492 filed Oct. 16, 2015, entitled "Self-Adhesive Eyelashes Extension Set," which is a continuation of U.S. patent application Ser. No. 13/952,352, filed Jul. 26, 2013, now U.S. Pat. No. 9,185,943, entitled "Self-Adhesive Eyelashes Extension Set," which is a continuation of U.S. patent application Ser. No. 11/695,033, filed Apr. 1, 2007, now abandoned, which claims the benefit of U.S. patent application No. 60/744,131, filed Apr. 2, 2006, all of which are incorporated herein by reference in their entirety.

STATEMENT REGARDING FEDERALLY SPONSORED RESEARCH OR DEVELOPMENT

Not applicable.

BACKGROUND

The present invention is in the field of cosmetic materials. More specifically, the present invention relates to personal grooming and to artificial eyelashes adapted for attachment onto hair growing from an eyelid.

The cosmetic use of artificial eyelashes by persons in the making of their toilet is old in the art. Typically, eyelash sets comprise left and right arrays of lash hairs held together on an adhesive strip, and the array is attached to the skin of the upper eyelid of the wearer to cosmetically extend the length of the wearer's natural eyelashes. The individual hairs of the array are aligned with their bases in a substantially common direction. The bases of the lash hairs are embedded in the support strip, preferably in its leading edge. It is known in the art how to produce, select, sculpt and arrange the individual hairs of the array to provide various aesthetically desirable configurations of the array in combination with the support strip.

As noted above, prior art artificial eye lashes typically are applied to the skin of the wearer. It would be beneficial to have an alternative that does not attach to or contact the skin of the wearer. A benefit of this a reduced risk that the wearer would be exposed to the solvents or other chemicals in the adhesive and mounting strip of the eyelash strip. Additionally, if it is desired for regular adherence of the artificial eyelash by the application of pressure to the adhesive, it would be beneficial to be able to avoid applying the pressure directly to the tissue (i.e., eyelid and/or eyeball) of the wearer. It would also be beneficial in the field to be able to remove and reapply the artificial eyelash strips.

SUMMARY

The present invention is a self-adhesive artificial eyelash unit that attaches to a subject wearer's existing natural eyelashes to modify their appearance. The unit is preferably applied as a left and right set of units, with the left and the right sets including an upper unit and optionally including a lower unit. The left and right sets correspond to the wearer's left and right eyes. The upper and lower units of a set correspond to the upper and lower surfaces of a wearer's natural eyelashes. Each unit includes an array of artificial lash hairs, each lash hair having a base and a tip. Preferably, the artificial lash hairs are sculpted, in that the base of the individual lash hair is thicker than its tip. The lash hairs are somewhat spaced apart in the array with their bases in a common direction relative to a support strip. The bases are received in the support strip, preferably at its leading edge. The support strip has an adhesive-receiving surface on which an adhesive is disposed. In the embodiments illustrated, the support strip was made of polyurethane and had the bases of the hairs of the array of artificial lash hairs embedded in the polyurethane of the leading edge of the support strip. An adhesive is disposed on the adhesive-receiving surface of the support strip. The adhesive releasably attaches the support strip to the existing natural eyelashes of the wearer to provide for cosmetically altering the appearance of the wearer's natural eyelashes. The adhesive may be supplied in place on a unit and covered with a removable protective covering, or may be separately applied to the adhesive receiving surface by the wearer just prior to use.

DETAILED DESCRIPTION

Figure 1:
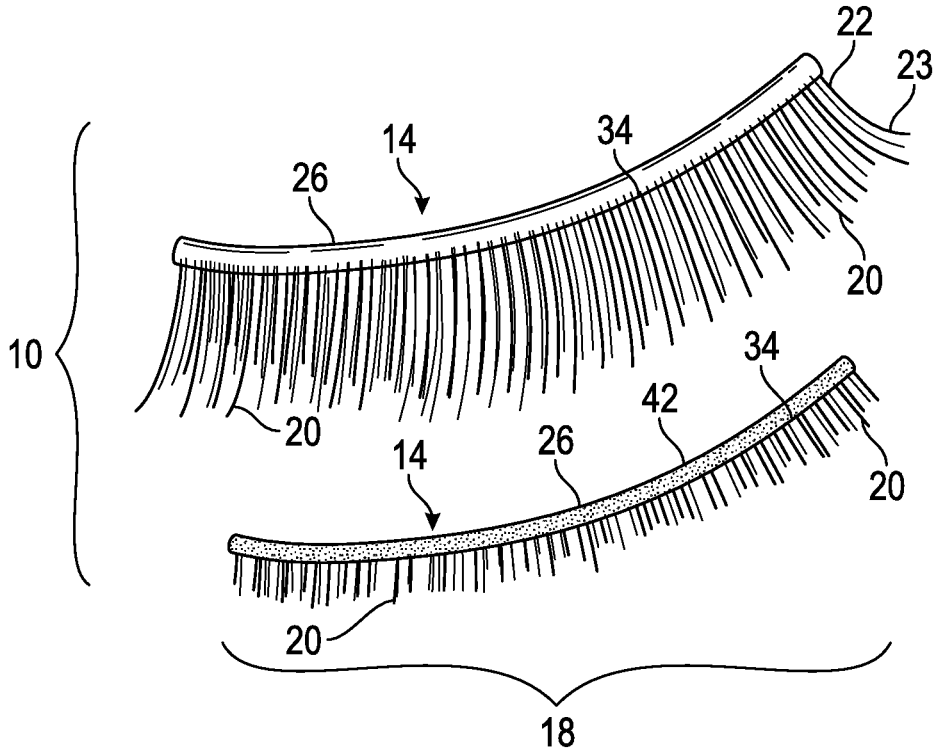
FIG. 1 is a top plan view of a self-adhesive artificial eyelash extensions set of the present invention, comprising a pair of lash extension units: an upper unit and a lower unit.

Referring now to the drawings, the details of the embodiments of the present invention are graphically and schematically illustrated. Like elements in the drawings are represented by like numbers, and any similar elements are represented by like numbers with a different lower case letter suffix.

Figure 3:
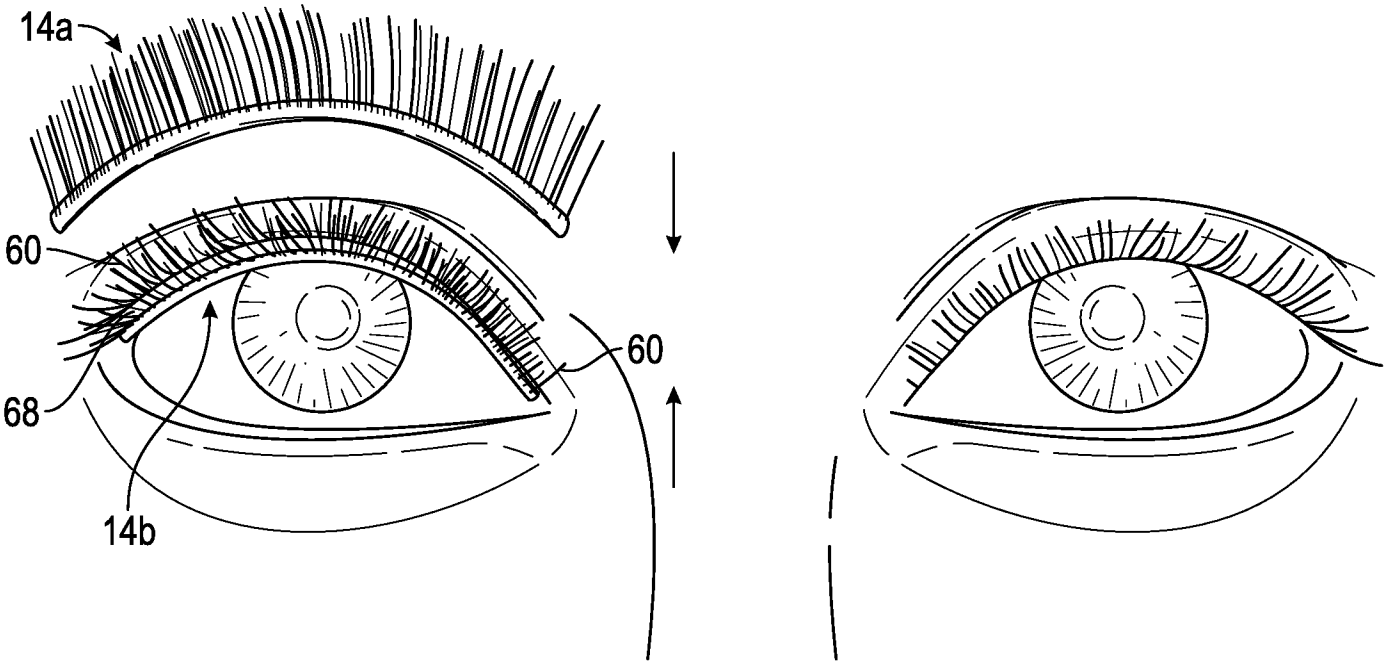
FIG. 3 is a front view of a self-adhesive artificial eyelash extension set of the present invention positioned to be installed on a subject wearer's existing natural eyelashes.

As illustrated in FIG. 1, the present invention is self-adhering artificial eyelashes extensions 10 for attachment to a subject wearer's existing natural eyelashes 60 (see FIGS. 3 and 4) to provide the cosmetic appearance of natural looking longer and fuller eyelashes, or alternatively, fanciful eyelashes. An eyelashes extension unit 14 is made up of an array 18 of artificial lash hairs 20, each lash hair 20 having a base 22 and a tip 23. The individual hairs 20 of the array 18 are aligned with their bases 22 in a substantially common direction relative to a support strip 26. The bases 22 of the lash hairs 20 are embedded in the support strip 26, preferably in its leading edge 34. It is known in the art how to produce, select, sculpt and arrange the individual hairs 20 of the array 18 to provide various aesthetically desirable configurations of the array 18 in combination with the support strip 26.

Figure 2:
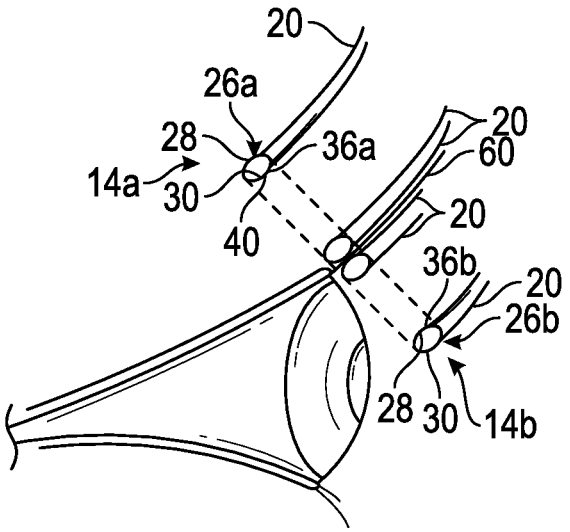
FIG. 2 is side view of a self-adhesive artificial eyelash extension set of the present invention installed on a subject wearer's existing natural eyelashes.

In the preferred embodiment illustrated in the figures, the support strip 26 of the lash extension unit 14 is made of polyurethane. Additionally, as illustrated in FIGS. 1 and 2, the support strip 26 has a top surface 28, a bottom surface 30 and a leading edge 34. The bases 22 of the lash hairs 20 of the artificial lash hair array 18 are embedded in the polyurethane of the leading edge 34 of the support strip 26. On any lash extension unit 14, one of the surfaces 28, 30 of the support strip 26 is also an adhesive surface 36 disposed to receive a film or a layer 40 of an adhesive 42.

The adhesive 42 disposed on the adhesive surface 40 of a support strip 26 enables the strip 26 of the lash extension unit 14 with its array 18 of artificial lash hairs 20 to be releasably adhered to the existing natural lashes 60 of the wearer.

In a preferred embodiment, the adhesive 42 is a silicone-based composition. However, other adhesive compositions are known to and are selectable by one of ordinary skill in the art. For example, a heat or light cured self-adhering composition may be particularly advantageous.

Attaching a present self-adhering artificial eyelashes extensions unit 14 to the existing natural eyelashes 60 of the wearer provides for cosmetically extending the length of the wearer's natural eyelashes 60.

In a preferred embodiment illustrated in the figures, the present self-adhering artificial eyelashes extensions are provided as a matched set of two units 14, the set being made up of an upper unit 14*a* (see FIG. 2) for attachment to the top side of the existing natural eyelashes 60 on a wearer's upper eyelid 68, and a lower unit 14*b* for attaching to the bottom side of the same eyelashes. In this embodiment, the self-adhesive artificial eyelash extension set 10 comprises two support strips, one being an upper unit support strip 26*a* and the other being a lower unit support strip 26*b*, the upper unit support strip 26*a* has a bottom adhesive surface 36*a*, and the lower unit support strip 26*b* has an upper adhesive surface 36*b*.

In using the present invention, the wearer's existing natural lashes 60 (e.g., of the wearer's upper eyelid) are sandwiched between the upper and lower lash hair units 14*a* & 14*b* of a lash extension set 10 of the present invention. The self-adhering adhesives 42 of the two lash hair extension units 14*a* & 14*b* come into contact and bond the two adhesive layers together with the wearer's existing natural lashes 60 disposed between them. In a preferred embodiment, the adhesive 42 is contact sensitive. However, pressure sensitive and heat or light setting adhesives may be practiced in the present invention, if the adhesive effect can be released to enable removal of the artificial lash extension units.

Figure 4:
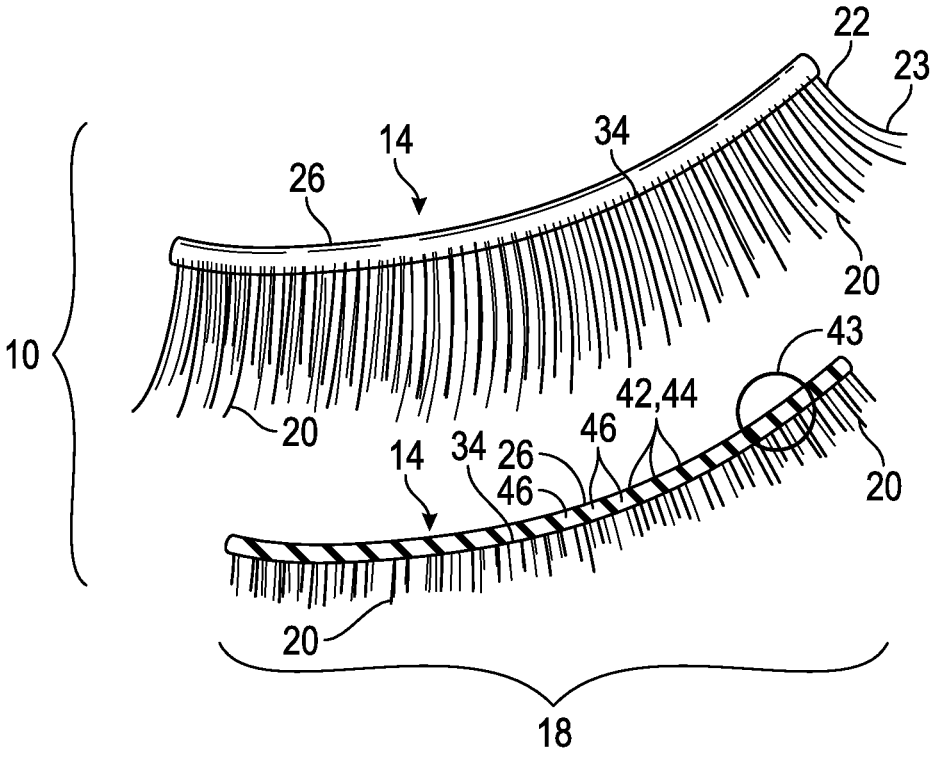
FIG. 4 is a top plan view of an alternate embodiment of the invention in which adhesive is applied intermittently.

Referring now to FIG. 4, in another embodiment, the adhesive 42 is distributed intermittently across the adhesive-receiving surface, or in a pattern 43, such that, for at least one of the matched pair, not the entire surface is covered with adhesive. The disposition of the adhesive 42 in such a pattern 43 can help optimize the adhering characteristics of the upper and lower matched set, together making it easier to remove such artificial units 14 or makes them more permanent, according to the desire of the wearer or the cosmetician. For example, the adhesive pattern 43 may be strips 44 of adhesive parallel to and aligned with the hairs 20 having non-adhesive spaces 46 in between of a width comparable to that of the adhesive strip width (e.g., the width of four human hairs), thereby allowing a cosmetician or the wearer to simply offset one unit with respect to another in order to control the amount of adhering force, thereby eliminating the need for a large stock of eyelash units 14 having a varying amount of adhesive 42.

In another embodiment, one of the matched pairs of units 14 does not have any adhesive 42 and relies on the adhesive present on the matched unit, passing between natural lashes 60, and contacting the surface of the unit, to retain the assembly together.

Although it is the primary intent of the invention to provide an artificial eyelash unit 14 or lash set 10 that enhances a wearer's eyelashes 60 such that they appear natural, fuller, longer and consequently, more attractive, the invention allows for a departure from this usual goal, without departing from the spirit and scope of the invention. In other words, although the polyurethane strip 26 is generally made dark or clear and the artificial lashes 20 of a natural color, the strip 26 may even be made of different colors and be of differing sizes according to the desire of the wearer. Such strip 26 may even embedded with a metallic glitter, according to the desire of the wearer. Further, text may be printed on the non-adhesive surface of the strip 26, such as the trademark of the manufacturer, or a phrase or expression invoking a theme, perhaps even including the name of the wearer. Such strip 26 may optionally be embedded with a material which absorbs light energy and emits the absorbed light at a predetermined level or rate, such that when ambient light level is lower than the emission rate, the strip 26 is ruminated. Further, the self-adhering artificial eyelashes extensions 10 may be made up of artificial eyelashes 20 of a fanciful color, like gold or silver, or some other color, and may be luminescent as well. The array 18 may be homogeneous or include a pattern of different color eyelashes 20, randomly mixed, alternating one to the other, or set in groups of lashes of different colors.

In another embodiment, the attachment may be accomplished by mechanically interlocking the units to each other (and to the natural eyelashes) using a suitable loop-and-hook combination (e.g., a VELCRO™-type combination), wherein each matched strip 26 has a complementary mechanical structure which engages with a corresponding mechanical structure of the matching strip 26 as well as with the natural lashes 60 themselves.

In an advantage, the invention provides an artificial eyelash that enhances a wearer's eyelashes 60 such that they appear natural, fuller and consequently, more attractive. This is due to the fact that sandwiching of the natural lash 60 between two artificial lash units 14 that better cover the natural lashes, thereby making them appear more consistent and fuller.

In another advantage, the level of permanence of such eyelash assembly 10 may be controlled by controlling the amount or pattern of adhesive on the eyelash strips 26.

In another advantage, a wearer may select from a wide variety of appearance from a natural appearance to a fanciful appearance.

In another advantage, the invention conveys a desired message by permitting printing on the eyelash strip 26.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A method of applying an artificial eyelash extension system comprising:

positioning a first eyelash extension unit above a wearer's natural eyelashes;

positioning a second eyelash extension unit below a wearer's natural eyelashes;

contacting a support strip of the first eyelash extension unit with a support strip of the second eyelash extension unit; and engaging the support strips such that the support strips are sandwiched about and retained on the natural eyelashes and a first array of artificial eyelashes extend from the first support strip above the natural eyelashes and a second array of artificial eyelashes extend from the second support strip below the natural eyelashes.

2. The method of claim 1 wherein the support strips comprise polyurethane to surround and capture the base of each artificial eyelash.

3. The method of claim 1 wherein the first array of artificial eyelashes extend a first distance from the first support strip, the second array of artificial eyelashes extend a second distance from the second support strip, and the first distance is greater than the second distance.

4. The method of claim 1 further comprising removing the support strips from each other and from the natural eyelashes.

5. The method of claim 1 wherein the engaging the support strips comprises adhering the support strips with an adhesive.

6. The method of claim 1 further comprising applying heat, light, pressure, or a combination thereof to an adhesive between the support strips.

7. The method of claim 1 wherein the engaging the support strips comprises engaging a complementary mechanical structure with a corresponding mechanical structure.

8. A method of applying an artificial eyelash extension system comprising:

positioning a first eyelash extension unit above a wearer's natural eyelashes;

positioning a second eyelash extension unit below a wearer's natural eyelashes;

contacting a support strip of the first eyelash extension unit with a support strip of the second eyelash extension unit; and attaching the support strips such that the support strips are sandwiched about and retained on the natural eyelashes and a first array of artificial eyelashes extend from the first support strip above the natural eyelashes and a second array of artificial eyelashes extend from the second support strip below the natural eyelashes.

9. The method of claim 8 wherein the support strips comprise polyurethane to surround and capture the base of each artificial eyelash.

10. The method of claim 8 wherein the first array of artificial eyelashes extend a first distance from the first support strip, the second array of artificial eyelashes extend a second distance from the second support strip, and the first distance is greater than the second distance.

11. The method of claim 8 further comprising removing the support strips from each other and from the natural eyelashes.

12. The method of claim 8 wherein the attaching the support strips comprises adhering the support strips with an adhesive.

13. The method of claim 8 further comprising applying heat, light, pressure, or a combination thereof to an adhesive between the support strips.

14. The method of claim 8 wherein the attaching the support strips comprises engaging a complementary mechanical structure with a corresponding mechanical structure.

15. A method of applying an artificial eyelash extension system comprising:

positioning a first eyelash extension unit above a wearer's natural eyelashes;

positioning a second eyelash extension unit below a wearer's natural eyelashes;

contacting a support strip of the first eyelash extension unit with a support strip of the second eyelash extension unit; and retaining the support strips such that the support strips are sandwiched about and attached to the natural eyelashes and a first array of artificial eyelashes extend from the first support strip above the natural eyelashes and a second array of artificial eyelashes extend from the second support strip below the natural eyelashes.

16. The method of claim 15 wherein the first array of artificial eyelashes extend a first distance from the first support strip, the second array of artificial eyelashes extend a second distance from the second support strip, and the first distance is greater than the second distance.

17. The method of claim 15 further comprising removing the support strips from each other and from the natural eyelashes.

18. The method of claim 15 wherein the retaining the support strips comprises adhering the support strips with an adhesive.

19. The method of claim 15 further comprising applying heat, light, pressure, or a combination thereof to an adhesive between the support strips.

20. The method of claim 15 wherein the retaining the support strips comprises engaging a complementary mechanical structure with a corresponding mechanical structure.

* * * * *